US009025983B2

(12) United States Patent
Otaki

(10) Patent No.: US 9,025,983 B2
(45) Date of Patent: May 5, 2015

(54) IMAGE FORMING APPARATUS HAVING A COOLING UNIT AND METHOD FOR FORMING IMAGE USING THE SAME

(71) Applicant: Toshiba Tec Kabushiki Kaisha, Tokyo (JP)

(72) Inventor: Mitsuhiko Otaki, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/863,129

(22) Filed: Apr. 15, 2013

(65) Prior Publication Data

US 2013/0272739 A1 Oct. 17, 2013

Related U.S. Application Data

(60) Provisional application No. 61/625,019, filed on Apr. 16, 2012.

(51) Int. Cl.
*G03G 15/20* (2006.01)
*G03G 21/00* (2006.01)

(52) U.S. Cl.
CPC ..... *G03G 15/2003* (2013.01); *G03G 15/2017* (2013.01); *G03G 15/205* (2013.01); *G03G 21/00* (2013.01)

(58) Field of Classification Search
USPC ..... 399/69, 92, 94, 341
See application file for complete search history.

(56) References Cited

U.S. PATENT DOCUMENTS

| | | | | |
|---|---|---|---|---|
| 7,962,052 | B2 * | 6/2011 | Ishino | 399/69 |
| 8,218,992 | B2 * | 7/2012 | Park | 399/69 |
| 8,693,912 | B2 * | 4/2014 | Fujiwara | 399/69 |
| 8,744,312 | B2 * | 6/2014 | Yamashita | 399/119 |
| 2012/0013929 | A1 | 1/2012 | Otaki | |

FOREIGN PATENT DOCUMENTS

JP 2012-078808 4/2012

* cited by examiner

*Primary Examiner* — William J Royer
(74) *Attorney, Agent, or Firm* — Patterson & Sheridan, LLP

(57) ABSTRACT

An image forming apparatus has an image forming unit configured to form an image on a sheet using a decolorable toner, a fixing unit configured to fix the image on the sheet by heating, a cooling unit for cooling the fixing unit, and a control section for controlling the cooling unit. The control section turns on the cooling unit if the control section determines that the temperature of the fixing unit is at or above a predetermined temperature.

20 Claims, 4 Drawing Sheets

IMAGE FORMING APPARATUS HAVING A COOLING UNIT AND METHOD FOR FORMING IMAGE USING THE SAME

CROSS-REFERENCE TO RELATED APPLICATION

This application is based upon and claims the benefit of priority from U.S. Provisional Patent Application No. 61/625,019, filed on Apr. 16, 2012, the entire contents of which are incorporated herein by reference.

FIELD

Embodiments described herein relate to an image forming apparatus.

BACKGROUND

An image forming apparatus that forms an image using a decolorable toner, the color of which can be erased, is known. The decolorable toner can be used like a conventional non-decolorable toner when forming the image. When the image is formed, the image formed by the toner is fixed on a sheet of paper by heating a fixing unit to a certain temperature, e.g., 100° C., and conducting the heat to the toner. The color of the decolorable toner can be erased by heating the fixing unit to a certain temperature, e.g. 120° C.-150° C., at which the color of the toner disappears, and conducting the heat to the toner. Thus, the temperature at which the color of the decolorable toner disappears is higher than the temperature at which the decolorable toner forming an image is fixed on the sheet of paper.

If image forming is continuously carried out, the temperature of the fixing unit may reach a temperature at which the color of the decolorable toner disappears. In addition, when the apparatus is switched to an image forming mode from an erasing mode, if the apparatus has both functions of image forming and image erasing, the temperature of the fixing unit may not fall to the temperature for forming the image soon enough. In such situations, images cannot be formed on the paper, and the apparatus has to wait until the temperature of the fixing unit drops sufficiently. This waiting time can be very inconvenient for the user.

DETAILED DESCRIPTION

Embodiments of the present disclosure are directed to efficient forming of images on the sheets of paper without wasting time.

An image forming apparatus according to the embodiments of the present disclosure has an image forming unit configured to form an image on a sheet using a decolorable toner, a fixing unit configured to fix the image on the sheet by heating, a cooling unit for cooling the fixing unit, and a control section for controlling the cooling unit. The control section turns on the cooling unit if the control section determines that the temperature of the fixing unit is at or above a predetermined temperature.

The present embodiment will be explained below with reference to the drawings.

Figure 1:
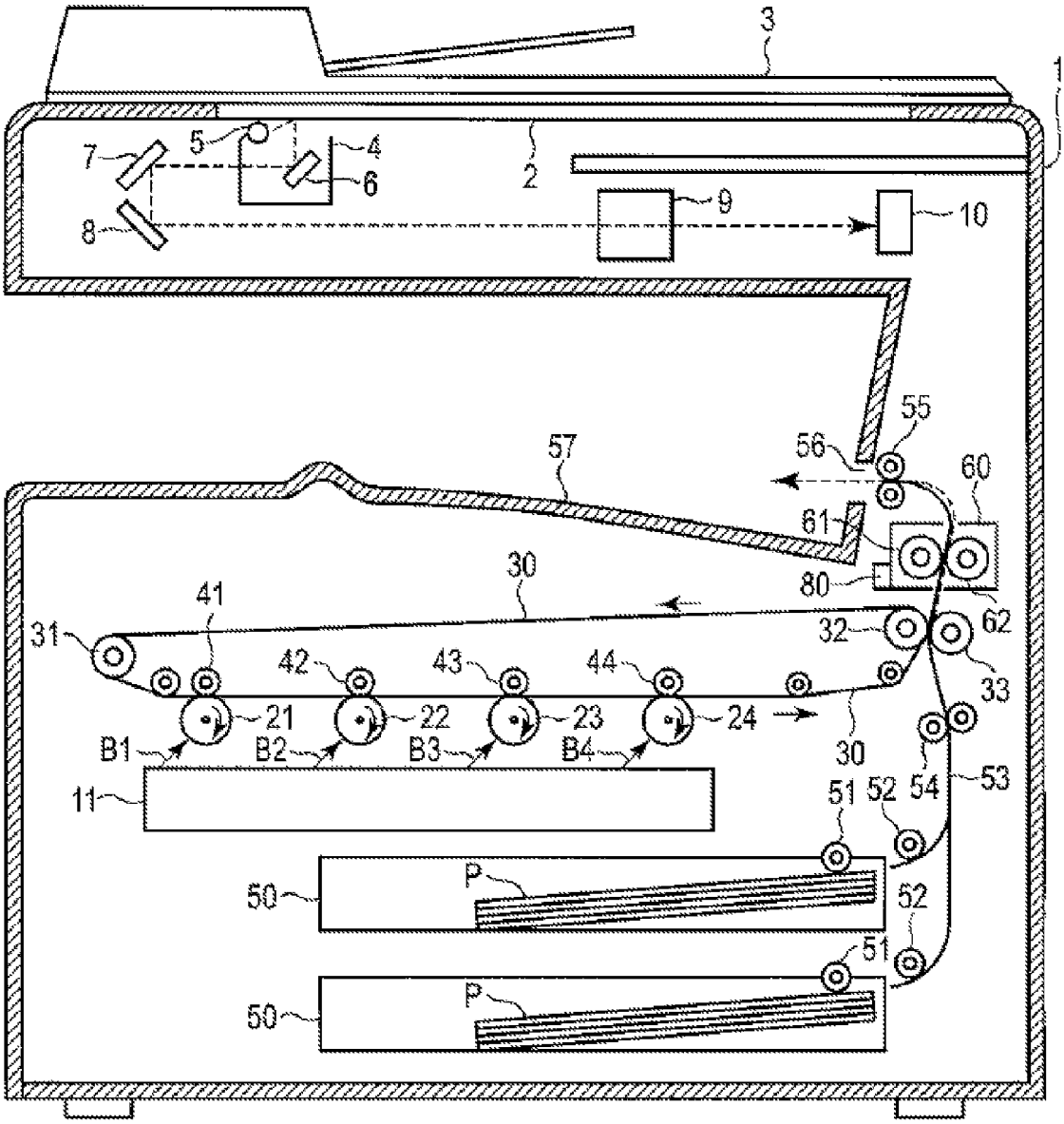
FIG. 1 is a drawing showing a configuration of an image forming apparatus according to a present embodiment.

As shown in FIG. 1, a transparent platen (glass plate) 2 on which an original document is to be placed is provided at the top of a main body 1, and a cover 3 is placed in an openable and closable manner on the platen 2. A carriage 4 is provided under the platen 2, and an exposure lamp 5 is provided in the carriage 4. The carriage 4 reciprocates below the lower surface of the platen 2. While the carriage 4 reciprocates, the original document placed on the platen 2 is illuminated (exposed) by the exposure lamp 5. The lights reflected at the original document are directed to a CCD (charge-coupled device ) 10 by reflective mirrors 6, 7, and 8. The lights then pass through a lens block 9 for zooming and projected onto the CCD 10. The CCD 10 outputs an image signal at a level corresponding to the intensity of the lights projected onto the CCD 10.

Figure 4:
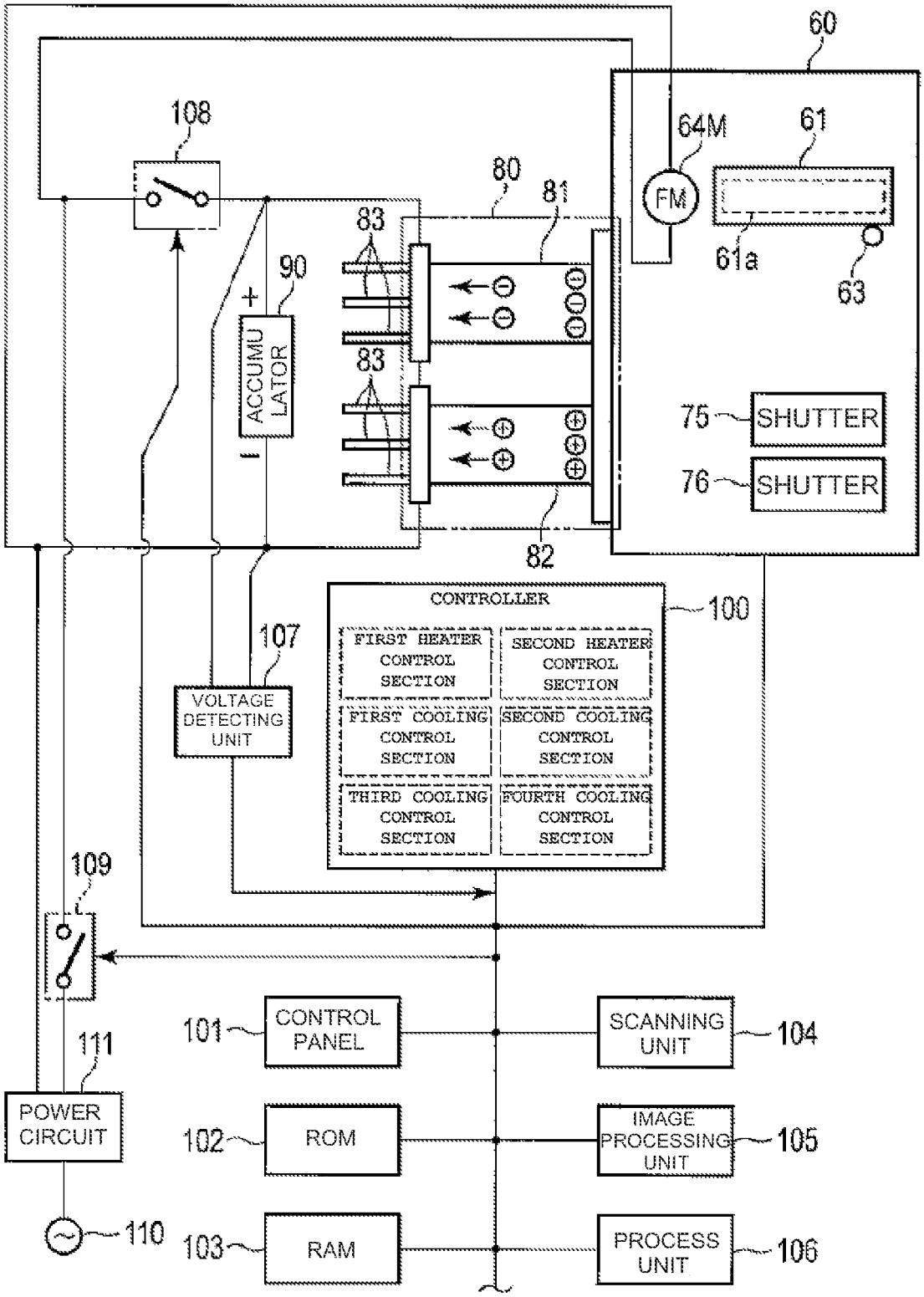
FIG. 4 is a block diagram showing a control circuit of the image forming apparatus of FIG. 1.

The carriage 4, the exposure lamp 5, the reflective mirrors 6, 7, and 8, the lens block 9 for zooming, and the CCD 10 are included in a scanning unit 104 (shown in FIG. 4). Thus, the scanning unit 104, as a whole, optically scans and reads the image of the original document placed on the platen 2. The detail explanation of the scanning unit 104 will be explained later.

The image signal output from the CCD 10 is processed accordingly and then supplied to an exposure unit 11. The exposure unit 11 emits a laser beam B1 corresponding to the image signal of yellow color, a laser beam B2 corresponding to the image signal of magenta color, a laser beam B3 corresponding to the image signal of cyan color, and a laser beam B4 corresponding to the image signal of black color towards photo sensitive drums 21-24, respectively. The photo sensitive drums 21-24, thus, hold latent images corresponding to the yellow color, the magenta color, the cyan color, and the black color, respectively. Then, toner images corresponding to the latent images are formed on the photo sensitive drums 21-24. Thus, the photosensitive drums 21-24 serve as image bearing members for the yellow color, the magenta color, the cyan color, and the black color, respectively.

The photosensitive drums 21, 22, 23, and 24 are arranged in a nearly horizontal direction with a regular interval therebetween. A transfer belt 30, which serves as an image bearing member, is provided on the photosensitive drums 21, 22, 23, and 24. This transfer belt 30 is moved by a drive roller 31 and a driven roller 32. Thus, the transfer belt 30 receives the kinetic power from the drive roller 31, and the transfer belt 30 moves in a counterclockwise direction.

Primary transfer rollers 41, 42, 43, and 44 are provided so that they can move up and down freely at positions adjacent to the photosensitive drums 21, 22, 23, and 24 with downward pushing forces, respectively. The primary transfer rollers 41, 42, 43, and 44 rotate while pushing the transfer belt 30 onto the surfaces of the photosensitive drums 21, 22, 23, and 24. Since the transfer belt 30 contacts the photosensitive drums 21, 22, 23, and 24, the toner images (visible images) on the photosensitive drums 21, 22, 23, and 24 are transferred to the transfer belt 30.

Figure 2:
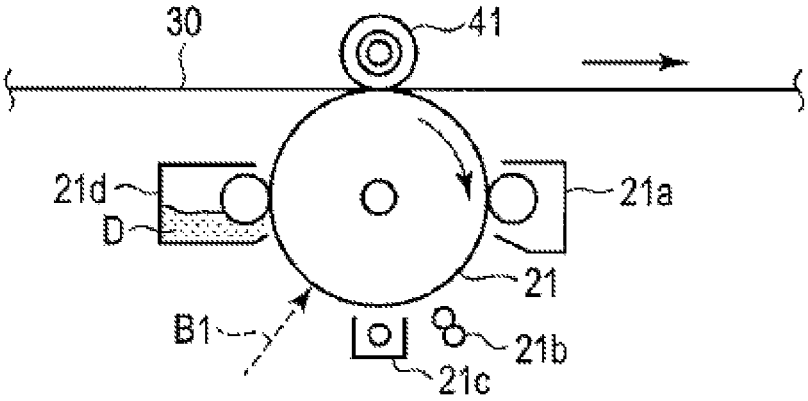
FIG. 2 is a drawing showing a configuration of a photosensitive drum and its peripherals in the image forming apparatus of FIG. 1.

FIG. 2 shows the configuration of the photosensitive drum 21 and its peripheral portion.

A cleaner 21*a*, a discharge lamp 21*b*, a charging unit 21*c*, and a developing unit 21*d* are sequentially disposed around the photosensitive drum 21. The cleaner 21*a* removes a developing agent D remaining on the surface of the photosensitive drum 21. The discharging lamp 21*b* removes an electric charge remaining on the surface of the photosensitive drum 21. The charging unit 21*c* provides a static electric charge to the surface of the photosensitive drum 21. The laser beam B1 emitted from the exposure unit 11 is irradiated onto the surface of the photosensitive drum 21 that has been charged by the charging unit 21*c*. By this irradiation, an electrostatic latent image is formed on the surface of the photosensitive drum 21. The developing unit 21*d* develops the electrostatic latent image and makes the electrostatic latent image visible on the surface of the photosensitive drum 21 by supplying the developing agent D in a yellow color on the surface of the photosensitive drum 21.

The same configuration also applies to the peripheral portions of the other photosensitive drums 22, 23, and 24. Therefore, their explanations will be omitted. The developing agents D in magenta, cyan, and black colors are supplied to the photosensitive drums 22, 23, and 24, respectively.

The developing agent D for each color is a mixture of an erasable toner and a magnetic carrier. The erasable toner contains dyes and coloring agents. These dyes and coloring agents bind with each other when the ambient temperature is at lower than a certain value Ts, for example, 120° C. By this binding, the colors of the dyes become visible. In addition, the dyes and the coloring agents release this binding when the ambient temperature is at a certain value Ts or higher. By releasing this binding, the colors of the dyes become invisible.

A plurality of paper feed cassettes 50 are arranged below the exposure unit 11 (shown in FIG. 1). These paper feed cassettes 50 accommodate many sheets of paper P, which are recording media and have different sizes. Pick-up rollers 51 and paper-feed rollers 52 are arranged at the positions corresponding to these paper feed cassettes 50. Each of the pick-up rollers 51 takes out the paper P inside each of the paper feed cassettes 50 one sheet at a time. Each of the paper-feed rollers 52 conveys the paper P that has been taken out from each of the paper feed cassettes 50 along a conveying path 53.

The conveying path 53 extends to a paper discharge port 56, which is disposed above it, passing through resist rollers 54, the driven roller 32, a fixing unit 60, and paper-feed rollers 55. The paper discharge port 56 faces a paper discharge tray 57.

A secondary transfer roller 33 is disposed at a position facing the driven roller 32 and sandwiches the transfer belt 30 between it and the driven roller 32. Because the paper P that has been conveyed from the resist rollers 54 is sandwiched between the transfer belt 30 and the secondary transfer roller 33, the visible image formed on the transfer belt 30 is transferred to the paper P.

The fixing unit 60 fixes the visible image formed on the paper P to the paper P by heating the paper P at a first temperature T1, e.g. 100° C., which is less than the certain value Ts (=120° C.). Furthermore, the fixing unit 60 renders the image that has been fixed to the paper P invisible by heating the paper P to a second temperature T2, which is Ts or higher, e.g., 130° C.

Figure 3:
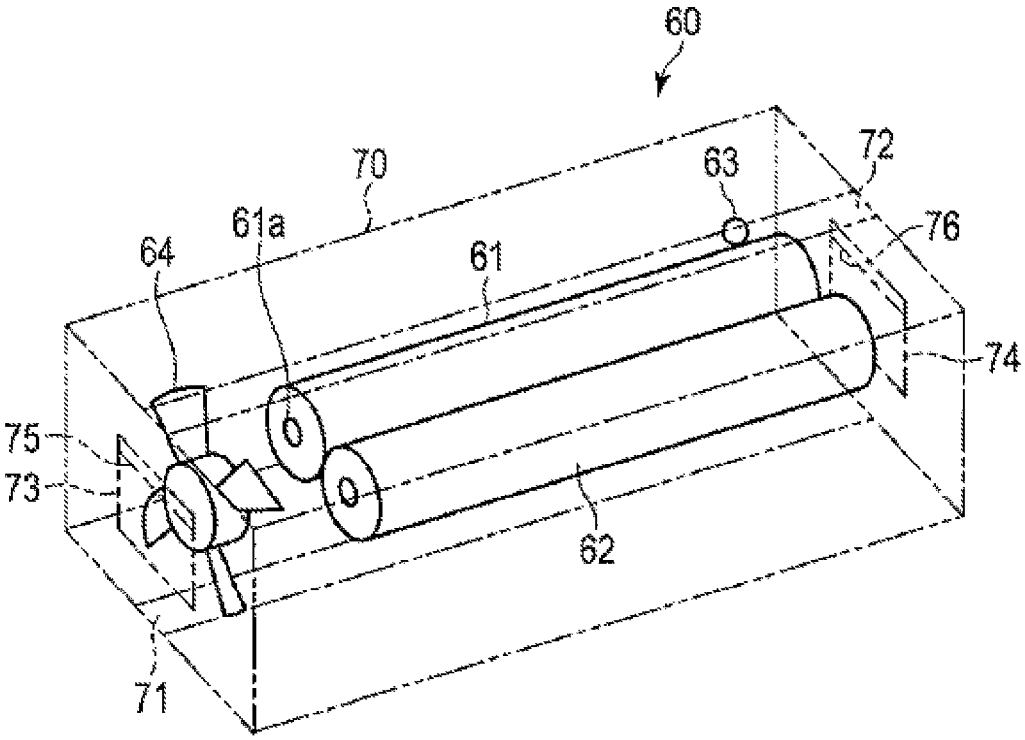
FIG. 3 is a drawing showing the configuration of a fixing unit of an image forming apparatus of FIG. 1.

As shown in FIG. 3, the fixing unit 60 has a heat roller 61, a heater 61*a*, a pressure roller 62, a temperature sensor 63, a cooling unit 64, e.g. a fan, and a cover 70. The heater 61*a* heats the heat roller 61 from the inside. Then, the heat roller 61 transfers the heat to the paper P. The pressure roller 62 pushes the paper P onto the heat roller 61 while it rotates along with the rotation of the heat roller 61 to convey the paper P. The temperature sensor 63 is in contact with the peripheral surface of the heat roller 61 and detects a temperature Th of the heat roller 61. The cooling unit 64 blows air in an axial direction of the heat roller 61 along the peripheral surface of the heat roller 61. The cover 70 has openings 71 and 72, through which the paper P passes, and the heat roller 61, the pressure roller 62, the temperature sensor 63, and the cooling unit 64 are disposed in the cover 70.

In addition, the temperature sensor 63 is disposed at a position where it can reliably detect the temperature Th of the heat roller 61, even when the cooling unit 64 is operating and air is blown on the peripheral surface of the heat roller 61.

An air inlet 73 and an air outlet 74 are provided in the cover 70. A shutter (first shutter) 75 is provided at the air inlet 73, and a shutter (second shutter) 76 is provided at the air outlet 74. The shutter 75 opens and closes the air inlet 73. The shutter 76 opens and closes the air outlet 74.

A thermoelectric conversion element 80 (shown in FIG. 1), which generates power by receiving heat from the fixing unit 60, is disposed on the cover 70 of the fixing unit 60.

FIG. 4 shows a control circuit of the main body 1. Connected to a controller 100 are the fixing unit 60, a control panel 101, a ROM 102, a RAM 103, the scanning unit 104, an image-processing unit 105, a process unit 106, a voltage-detecting circuit 107, and switches 108 and 109.

The control panel 101 has operation buttons and a touch panel-type liquid crystal display unit. It is possible to select either an image forming mode or a color-erasing mode with this control panel 101. The ROM 102 stores control programs. The RAM 103 is used for storing various data.

The scanning unit 104 includes the carriage 4, the exposure lamp 5, the reflective mirrors 6, 7, and 8, the lens block 9 for zooming, and the CCD 10, and the scanning unit 104 scans the image of the original document.

The image-processing unit 105 accordingly processes the image scanned by the scanning unit 104.

The process unit 106 includes the exposure unit 11, the photosensitive drums 21, 22, 23, and 24, the elements in the configuration of FIG. 2 surrounding these photosensitive drums 21, 22, 23, and 24 (i.e., the cleaners 21*a*, the discharging lumps 21*b*, the charging units 21*c*, and the developing units 21*d*), the transfer belt 30, the drive roller 31 and driven roller 32, the primary transfer rollers 41, 42, 43, and 44, the secondary transfer roller 33, and the like. The process unit 106 forms the image that has been processed by the image-processing unit 105 on the paper P by exposing the photosensitive drums 21, 22, 23, and 24 along the main scan direction and the sub-scan direction of the laser beams Bl, B2, B3, and B4.

The voltage-detecting unit 107 detects a voltage Eb of an accumulator 90.

In the thermoelectric conversion element 80, one end of an N-type semiconductor element 81 and one end of a P-type semiconductor element 82 are electrically connected, while the other ends of the N-type semiconductor element 81 and the P-type semiconductor element 82 are electrically separated. At the electrically-separated ends of the semiconductor elements 81 and 82, radiating fins 83 are provided. The heat retained by the fixing unit 60 is conducted to the electrically-connected ends of the semiconductor elements 81 and 82. On the other hand, the heat retained by the electrically-separated ends of the semiconductor elements 81 and 82 is released into the atmosphere via the radiating fins 83. Thus, difference of temperature exists between the electrically-connected ends and the electrically separated ends. Due to this difference of temperature, electrons gather at the electrically-separated end of the N-type semiconductor element 81 and electron holes gather at the electrically-separated end of the P-type semiconductor element 82. Then, an electric charge corresponding to the potential difference between the electrically-separated ends, which constitutes output voltage, are accumulated at the accumulator 90.

Therefore, the accumulator 90 is charged by the output voltage of the thermoelectric conversion element 80. The electric charge accumulated at the accumulator 90 is supplied to a fan motor 64M of the cooling unit 64, which is provided inside the fixing unit 60, if the switch 108 is turned on.

Furthermore, a power circuit 111 is connected to a commercial AC power source 110, and the electric power supplied from that power circuit 111 is supplied to the fan motor 64M if the switch 109 is turned on. The power circuit 111 converts the voltage of the commercial AC power source 110 to the DC voltage, if necessary to drive the fan motor 64M.

The controller 100 has the following sections (1) through (6):

(1) A first heater-control section, which controls the operation of the heater 61*a* so that the temperature Th (the temperature of the heat roller 61) becomes the first temperature T1 (=100° C.) when the image forming mode for forming the image on the paper P is selected.

(2) A second heater-control section, which controls the operation of the heater 61*a* of the heat roller 61 so that the temperature Th becomes the second temperature T2 (=130° C.) when the color-erasing mode for erasing the color of the image on the paper P is selected.

(3) A first cooling-control section, which turns on the switch 108 (and turns off the switch 109) and operates the fan motor 64M using the voltage applied to the accumulator 90 if the temperature Th is the certain value Ts or higher, and a voltage Eb (voltage of the accumulator 90) detected by the voltage-detecting circuit 107 is a predetermined value E1 or higher when the image forming mode is selected.

(4) A second cooling-control section, which turns on the switch 109 (and turns off the switch 108) and operates the fan motor 64M using the output voltage of the power circuit 111 if the temperature Th is the certain value Ts or higher, and the voltage Eb (voltage of the accumulator 90) detected by the voltage-detecting circuit 107 is less than a predetermined value El when the image forming mode is selected.

(5) A third cooling-control section, which turns off both of the switches 108 and 109 and stops the fan motor 64M if the temperature Th is less than the certain value Ts when the image forming mode is selected.

(6) A fourth cooling-control section, which opens the shutters 75 and 76 if the temperature Th is the certain value Ts or higher and closes the shutters 75 and 76 if the temperature Th is less than the certain value Ts when the image forming mode is selected.

Figure 5:
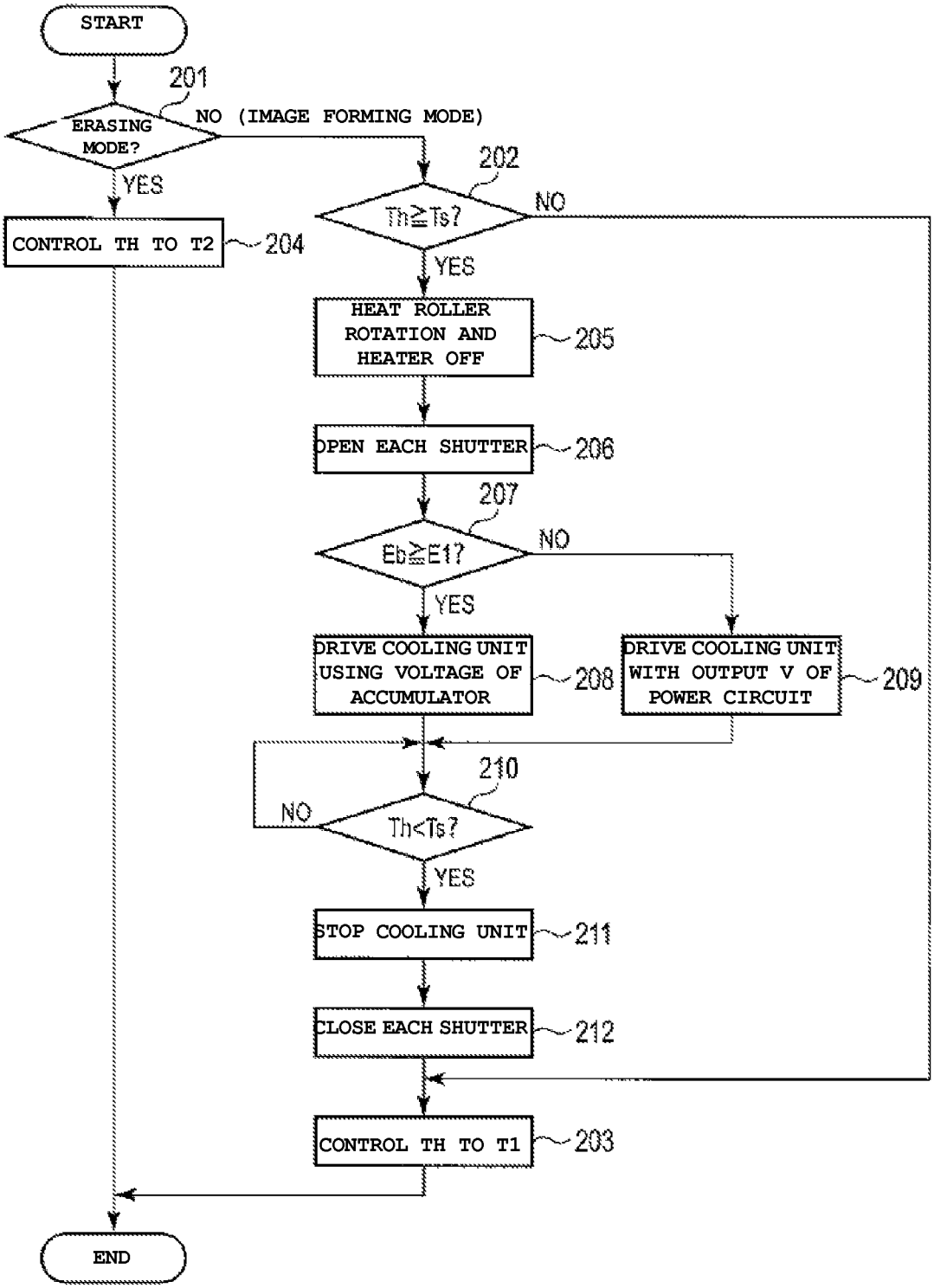
FIG. 5 is a flow chart for explaining a control operation of the image forming apparatus of FIG. 1.

Next, the operation of the controller 100 will be explained while referring to a flowchart in FIG. 5.

If the image forming mode is selected (NO in Act 201), the controller 100 compares the temperature Th detected by the temperature sensor 63 with the temperature Ts (e.g. 120° C.) (Act 202). If the temperature Th is less than the temperature Ts (NO in Act 202), the controller 100 controls the operation of the heater 61*a* of the heat roller 61 so that the temperature Th becomes the first temperature T1 for fixing (e.g. 100° C.) (Act 203).

By this control, the image of the original document placed on the platen 2 will be printed on the paper P.

If the user wants to erase the image on the paper P on which image formation has been carried out, the user places that paper P into the paper feed cassette 50 and sets the device in color-erasing mode using the control panel 101. If the color-erasing mode is selected, the controller 100 controls the operation of the heater 61*a* of the heat roller 61 so that the temperature Th becomes the second temperature T2 (e.g. 130° C.) (Act 204).

Since the color of the dyes formed on the paper P is heated to the temperature T2, which is equal to or higher than the temperature Ts at which the binding of the dyes and the coloring agents are released, the color of the image on the paper P will disappear, and the image will become invisible by this control.

However, if image forming is continuously carried out the temperature Th of the heat roller 61 may exceed the first temperature T1 (=100° C.) for fixing, even if the heater 61*a* is turned off. Thus, the temperature Th may reach a temperature range for the color-erasing mode (i.e., T2). In addition, if the operation mode is switched to the image forming mode after the color-erasing mode, the temperature Th of the heat roller 61 may not fall from the temperature range for the color-erasing mode (i.e., T2) to the temperature T1 at a fast enough rate, just by controlling the heater 61*a*.

Thus, if the image forming mode is selected (NO in Act 201), and if the temperature Th is at or higher than the temperature Ts (e.g. 120° C.) (YES in Act 202) or higher, the controller 100 turns off the heater 61*a* while rotating the heat roller 61 (Act 205). At the same time, the controller opens the shutters 75 and 76 of the cover 70 (Act 206).

Next, if the voltage Eb (voltage of the accumulator 90) detected by the voltage-detecting circuit 107 is the predetermined value E1 or higher (YES in Act 207), the controller 100 turns on the switch 108 (turns off the switch 109) and drives the fan motor 64M using the electric power accumulated at the accumulator 90 (Act 208). By driving the fan motor 64M, the cooling unit 64 inside the fixing unit 60 rotates, and the air for cooling is blown onto the heat roller 61. At this time, the shutter 75 of the air inlet 73 and the shutter 76 of the air outlet 74 are both opened so that the heat roller 61 can be efficiently cooled without retaining the heat inside the cover 70. In addition, the rotation of the heat roller 61 continues, further improving the cooling efficiency.

The accumulator 90 is charged using the output of the thermoelectric conversion element 80, which emits electric power by receiving the heat of the fixing unit 60. The electric power accumulated in the accumulator 90 is used to drive the cooling unit 64 so that consumption of the electric power from the commercial AC power source 110 can be avoided, resulting in energy savings.

If the voltage Eb is less than the predetermined value E1 (NO in Act 207), the controller 100 turns on (or keep turning on) the switch 109 (the switch 108 is off) and drives the fan motor 64M using the electric power supplied from the power circuit 111 (Act 209). Thus, even if the electric charges accumulated in the accumulator 90 are insufficient, the cooling unit 64 can be driven in a reliable manner. If the temperature Th is lower than the temperature Ts (Yes in Act 210), the controller 100 turns off the cooling unit 64 (Act 211) and closes the shutters 75 and 76 (Act 212). Then, the controller 100 controls the heater 61*a* so that the temperature Th becomes the first temperature T1 (Act 203). If the temperature Th is not lower than the temperature Ts (No in Act 210), Act 210 is repeated after a set amount of time.

In this way, the temperature Th of the heat roller 61 can be promptly lowered by driving the cooling unit 64, even if the temperature Th exceeds the temperature Ts. Therefore, interruption of image forming can be avoided or reduced as much as possible, improving the user's experience.

In the present embodiment, the fan is used as the cooling unit 64 for cooling the fixing unit 60. However, cooling unit 64 is not limited to the fan; other devices may also be used as long as they have the same function.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming unit configured to form an image on a sheet using a decolorable toner;

a fixing unit configured to fix the image on the sheet by heating;

a cooling unit for cooling the fixing unit; and a control section for controlling the cooling unit, wherein the control section turns on the cooling unit if the control section determines that the temperature of the fixing unit is at or above a predetermined temperature.

2. The image forming apparatus according to claim 1, wherein the control section controls the cooling unit so that the temperature of the fixing unit falls to a temperature below the predetermined temperature if the control section determines that the temperature of the fixing unit is at or above the predetermined temperature.

3. The image forming apparatus according to claim 1, wherein the control section controls heating of the fixing unit to be stopped if the control section determines that the temperature of the fixing unit is at or above the predetermined temperature.

4. The image forming apparatus according to claim 1, wherein the predetermined temperature is below the temperature at which a color of the image formed using the decolorable toner disappears.

5. The image forming apparatus according to claim 1, wherein the predetermined temperature is higher than 100° C. and lower than 130° C.

6. The image forming apparatus according to claim 1, wherein the control section controls heating of the fixing unit to a temperature at which a color of the image formed using the decolorable toner disappears if the control section determines that the image forming apparatus is in an image erasing mode, and controls heating of the fixing unit to a temperature at which the decolorable toner can be fixed on the sheet without erasing the color of the image formed using the decolorable toner if the control section determines that the image forming apparatus is in an image forming mode.

7. The image forming apparatus according to claim 1, further comprising:

a thermoelectric conversion element configured to generate electric power using heat from the fixing unit; and an accumulator configured to accumulate the electric power generated by the thermoelectric conversion element, wherein the control section controls the cooling unit to be driven using the electric power accumulated in the accumulator.

8. The image forming apparatus according to claim 7, wherein the control section controls the cooling unit to be driven using the electric power accumulated in the accumulator if the electric potential of the power accumulated at the accumulator is greater than or equal to a predetermined level, and using a power source of the image forming apparatus if the electric potential of the power accumulated at the accumulator is less than the predetermined level.

9. The image forming apparatus according to claim 1, wherein the fixing unit comprises a heat roller to heat the image on the sheet, and the control section controls the heat roller to be rotated if the control section determines that the temperature of the fixing unit is at or above the predetermined temperature.

10. The image forming apparatus according to claim 9, wherein the fixing unit further comprises a cover accommodating the heat roller that has a plurality of openings, and a plurality of shutters to gate the openings, and the control section controls the shutters to expose the openings to the outside if the control section determines that the temperature of the fixing unit is at or above the predetermined temperature.

11. A method for forming an image on a sheet using a decolorable toner in an image forming apparatus having a fixing unit configured to fix the image on the sheet by heating, the method comprising:

detecting a temperature of the fixing unit;

cooling the fixing unit by driving a cooling device if the detected temperature is at or above a predetermined temperature; and fixing the image on the sheet if the temperature of the fixing unit falls to a first temperature.

12. The method according to claim 11, further comprising:

heating the fixing unit, wherein heating of the fixing unit is stopped if the temperature of the fixing unit is at or above the predetermined temperature.

13. The method according to claim 11, wherein the predetermined temperature is below the temperature at which a color of the image formed using the decolorable toner disappears.

14. The method according to claim 11, wherein the predetermined temperature is higher than 100° C. and lower than 130° C.

15. The method according to claim 11, further comprising:

generating electric power using heat from the fixing unit; and accumulating the generated electric power, wherein the fixing unit is cooled using the accumulated electric power.

16. An image forming apparatus, comprising:

an image forming unit configured to form an image on a sheet using a decolorable toner;

a fixing unit configured to fix the image on the sheet by heating;

a cooling unit for cooling the fixing unit;

a sensor to detect a temperature of the fixing unit; and a control section for controlling the cooling unit, wherein the control section controls the cooling unit based on the temperature of the fixing unit.

17. The image forming apparatus according to claim 16, wherein the control section controls the fixing unit based on the temperature of the fixing unit.

18. The image forming apparatus according to claim 16, further comprising:

a thermoelectric conversion element configured to generate electric power using heat from the fixing unit; and an accumulator configured to accumulate the electric power generated by the thermoelectric conversion element, wherein the control section controls the cooling unit to be driven using the electric power accumulated in the accumulator.

19. The image forming apparatus according to claim 16, wherein the fixing unit comprises a heat roller to heat the image on the sheet, and the control section controls to rotate the heat roller based on the temperature of the fixing unit.

20. The image forming apparatus according to claim 19, wherein the fixing unit further comprises a cover accommodating the heat roller that has a plurality of openings, and a plurality of shutters to gate the openings, and the control section controls the shutters to expose the openings to the outside based on the temperature of the fixing unit.

* * * * *